US005552646A

United States Patent [19]

Frede

[11] Patent Number: 5,552,646

[45] Date of Patent: Sep. 3, 1996

[54] COMPACT CONTROL AND MONITORING SWITCH

[75] Inventor: Dieter Frede, Ennigerloh, Germany

[73] Assignee: Condor Werke-Gebruder Frede GmbH & Co KG, Ennigerloh, Germany

[21] Appl. No.: 332,996

[22] Filed: Nov. 1, 1994

[51] Int. Cl.[6] ..... H01H 35/24

[52] U.S. Cl. ..... 307/118; 307/116; 307/117; 307/125; 137/198; 137/212; 137/219; 303/82; 200/81 R; 200/83 W; 340/632

[58] Field of Search ..... 307/116, 117, 307/118, 125; 62/126, 179; 137/212, 214, 198; 303/82; 340/632; 200/81 R, 83 W

[56] References Cited

U.S. PATENT DOCUMENTS

| | | | |
|---|---|---|---|
| 1,841,477 | 6/1930 | Henning . | |
| 3,454,941 | 7/1969 | Voorman | 340/251 |
| 3,875,358 | 4/1975 | Willcox | 200/83 P |
| 3,949,179 | 4/1976 | Bauer | 200/83 R |
| 4,642,478 | 2/1987 | Noth | 307/118 |
| 4,686,834 | 8/1987 | Haley et al. | 62/209 |
| 5,209,076 | 5/1993 | Kauffman et al. | 62/126 |

FOREIGN PATENT DOCUMENTS 4308090 6/1994 Germany .

*Primary Examiner*—William M. Shoop, Jr.
*Assistant Examiner*—Albert W. Paladini
*Attorney, Agent, or Firm*—Bullwinkel Partners, Ltd.

[57] ABSTRACT

A device for control and monitoring of pressure in a system combines a conventional three pole pressure switch with the following additional features: (1) a lock mechanism with three influencing input factors and a single resulting output contact action, (2) a three pole thermal release device as one of the input factors, and (3) a remote control tripping device as another input factor, all integrated into a single, compact, modular unit. The thermal release device comprises a plurality of bimetals which sense electrical flow passing through the device, and which are mechanically connected to a locking mechanism to shut off current if the electrical flow reaches a predetermined maximum. If any of the three inputs activates the locking mechanism, the device must be reset by an operator.

15 Claims, 13 Drawing Sheets

FIG. 14
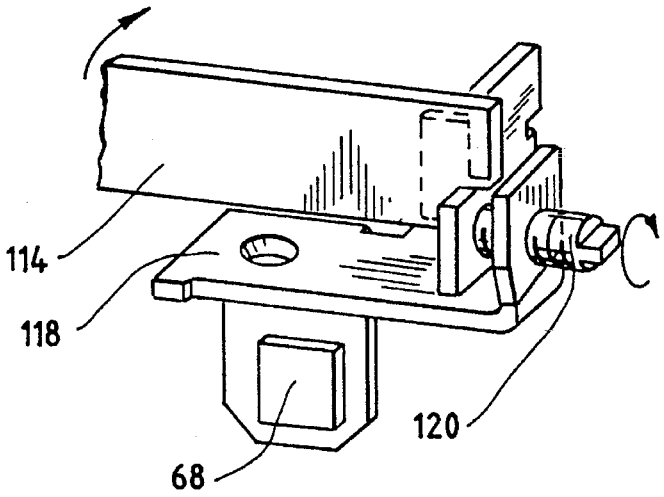
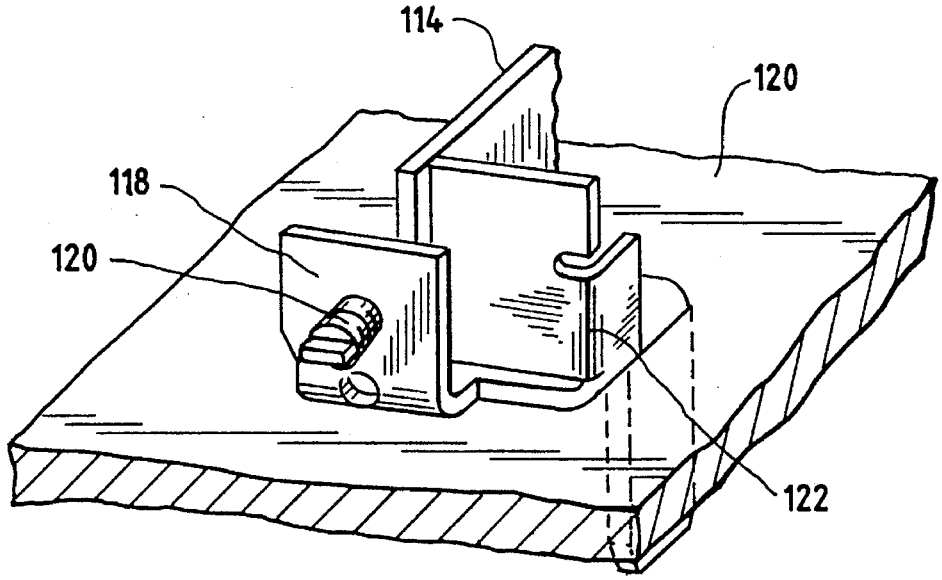
FIG. 13

COMPACT CONTROL AND MONITORING SWITCH

BACKGROUND

1. Field of the Invention

This patent relates to automatic control devices. More particularly, this patent relates to electric switches for controlling and monitoring the pressure in a system.

2. Description of the Related Art

Pressure switches are used to regulate the pressure within a system. For example, pressure switches can be used to regulate the air pressure within a tank used to supply air for spray painting. Standard pressure switches have a diaphragm which is open to the tank allowing the pressure switch to sense the pressure in the tank. The pressure drops as the air in the tank is used up. When the pressure in the tank reaches a minimum acceptable level, the pressure switch causes electrical contacts to close which starts up an electrical motor. The electrical motor runs a compressor which refills the tank with ambient air.

Pressure switches can operate a motor directly or operate a magnetic motor starter. In the latter case, the pressure switch acts as a relay to turn the starter on and off.

When a mechanical problem (e.g., a bad bearing) or an electrical problem (e.g., a low voltage condition) occurs in a compressor motor, the current passing through the motor increases to compensate, thus causing the motor to work harder. As the motor works harder, the motor temperature increases. When the temperature reaches the thermal limit of the insulation surrounding the motor, the motor can burn out, causing a short.

A significant disadvantage of most conventional pressure switches, such as those disclosed in Bauer U.S. Pat. No. 3,949,179 and Willcox U.S. Pat. No. 3,875,358, is that they do not have a thermal release device. That is, they have no means of sensing increased electrical current through the compressor motor and automatically shutting off if the current exceeds an acceptable level (i.e. overamperage).

Switches that have a thermal release device, such as Henning U.S. Pat. No. 1,841,477, have the disadvantage that, due to their one piece construction, they cannot be easily modified to match the amperage of a motor.

Another disadvantage of conventional pressure switches is that they cannot be turned off by remote control via an undervoltage release or shunt trip. Such remote control devices allow the compressor to be turned off by remote control in the case of an emergency.

Thus, there is a need for a pressure switch having a thermal release device and a remote control tripping device integrated into a single unit. The present invention provides such a device in a compact, modular design.

SUMMARY OF THE INVENTION

The present invention combines a conventional three pole pressure switch with the following additional features: (1) a lock mechanism with three influencing input factors and a single resulting output contact action; (2) a three pole overload monitor (thermal release device); and (3) a remote control tripping device.

The present invention comprises means for sensing the pressure in a system; switching means for opening and closing an electrical circuit in response to the pressure sensing means, and means for detecting an increase in electrical current through a motor, all integrated into a single, compact unit. Electrical current is detected by a plurality of bimetals (three for a three phase system) which are mechanically connected to the switching means to shut off current if the electrical flow through the motor reaches a predetermined maximum.

It is an object of the present invention to provide a pressure control device which automatically shuts off when it senses current overload through a compressor motor.

It is another object of the present invention to provide a pressure control device in which all the components needed to control pressure within a system and monitor current overload are integrated into a single very compact unit.

A further object of the present invention is to provide a switch of modular construction that can be easily modified to match the amperage of a motor.

A still further object of the present invention is to reduce the amount of wiring needed to that required for the connection between the compressor motor and the pressure switch and between the pressure switch and the power supply.

Still another object of the present invention is to provide pressure relief by an optional unloader valve each time the motor is switched off, thus ensuring pressureless motor starting.

Further and additional objects will appear from the description, accompanying drawings, and appended claims.

THE DRAWINGS

FIGS. 4–6 show a first embodiment of the modular contact block, wherein:

FIG. 4 is a right side view of the contact block, partially cut away to show one of the terminals;

FIG. 6 is a front view of the contact block of FIGS. 5A and 5B, partially cut away to show two sets of electrical contacts.

FIGS. 7 and 8 show a second embodiment of the modular contact block, having a mountable lock, wherein:

FIG. 7 is a right side view showing the mountable lock and manual "OFF-AUTO" knob; and FIG. 8 is a front view shown in partial cut away.

FIGS. 9–12 show a third embodiment of the modular contact block, having a mountable lock and a thermal release device, wherein:

FIG. 9 is a right side view partially cut away to show the thermal release device;

FIG. 10 is a front view;

FIG. 11 is a top view of the modular contact block showing the locking mechanism; and FIG. 12 is a side view of the modular contact block partially cut away to show the compensation bimetal.

FIG. 13 is an enlarged perspective view of the adjustment means for the thermal release device.

FIG. 14 is an enlarged perspective view of the adjustment means of FIG. 13 showing the direction of adjustment.

FIGS. 17 and 18 show the pressure switch of the present invention with an optional undervoltage release/shunt trip device, wherein:

FIG. 17 is a left side view of the pressure switch with undervoltage release/shunt trip device; and FIG. 18 is a rear view.

DETAILED DESCRIPTION OF THE INVENTION

Figure 1:
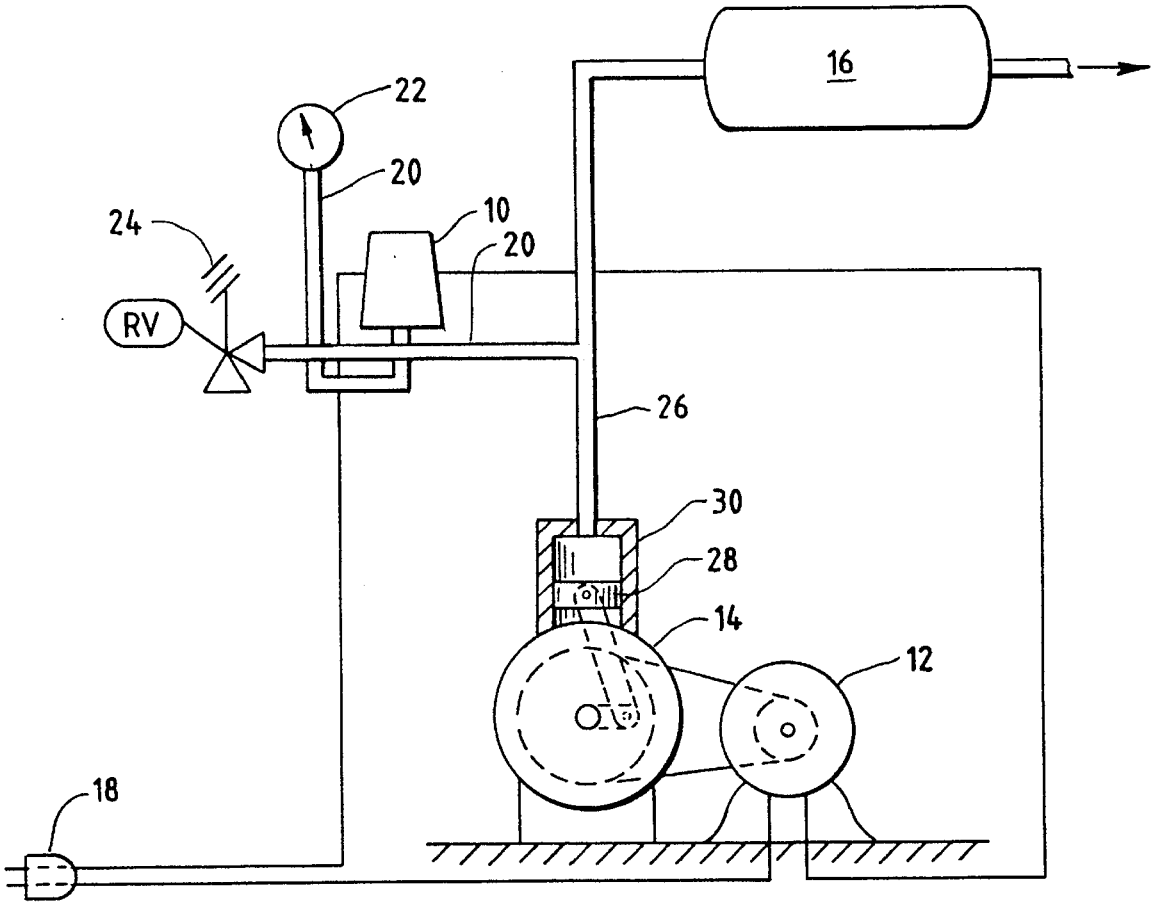
FIG. 1 is a schematic illustration of an air compressor system in which a pressure switch according to the present invention may be used.

Turning to the drawings, there is shown in FIG. 1 a diagram of a typical application of the present invention. Such an application generally would include a pressure switch 10, a motor 12, a compressor 14, an air storage tank 16 and an electrical source 18. Conduit 20 connects the pressure switch 10 to the compressor 14, to a pressure gauge 22, and to a pressure relief valve 24. More conduit 26 connects the compressor 14 to the air storage tank 16.

The pressure switch 10 is connected in series to the electrical source 18 and the motor 12. The motor 12 drives the air compressor 14 which typically operates a piston 28 moving in a cylinder 30.

The pressure switch 10 continually senses the pressure in the system and regulates the air pressure within the air storage tank 16. When the pressure in the air tank 16 drops to a predetermined minimum acceptable level, electrical contacts in the pressure switch 10 close, which starts up the motor 12. The motor 12 drives the compressor which refills the tank 16 with air. When the air pressure in the system reaches a predetermined maximum, electrical contacts within the pressure switch 10 open, shutting off the motor 12.

It will be noted that the system just described is for illustrative purposes only and that the present invention may be used in any number of industrial and commercial applications.

Figure 2:
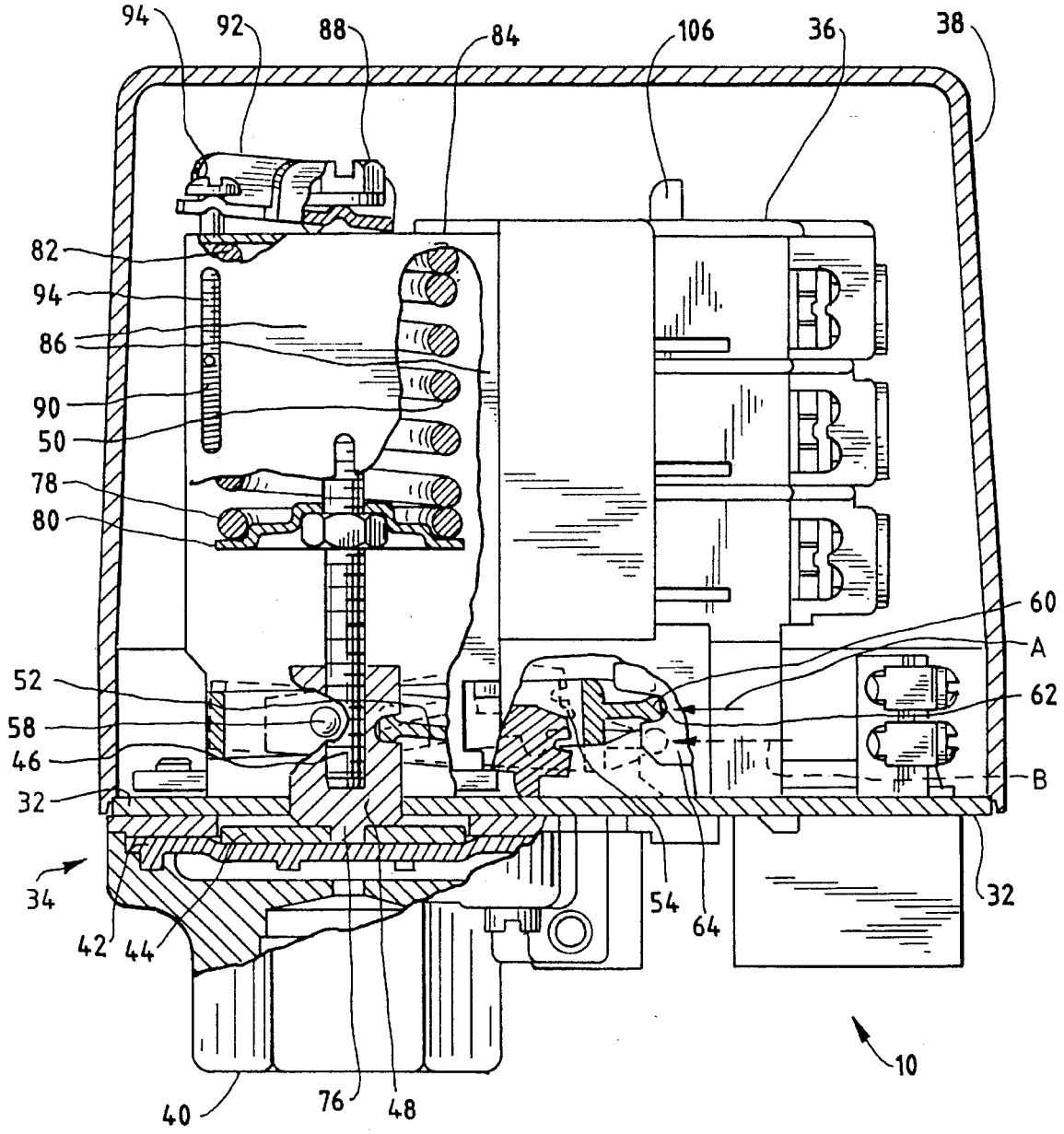
FIG. 2 is a right side view of one embodiment of the pressure switch of the present invention.
Figure 3:
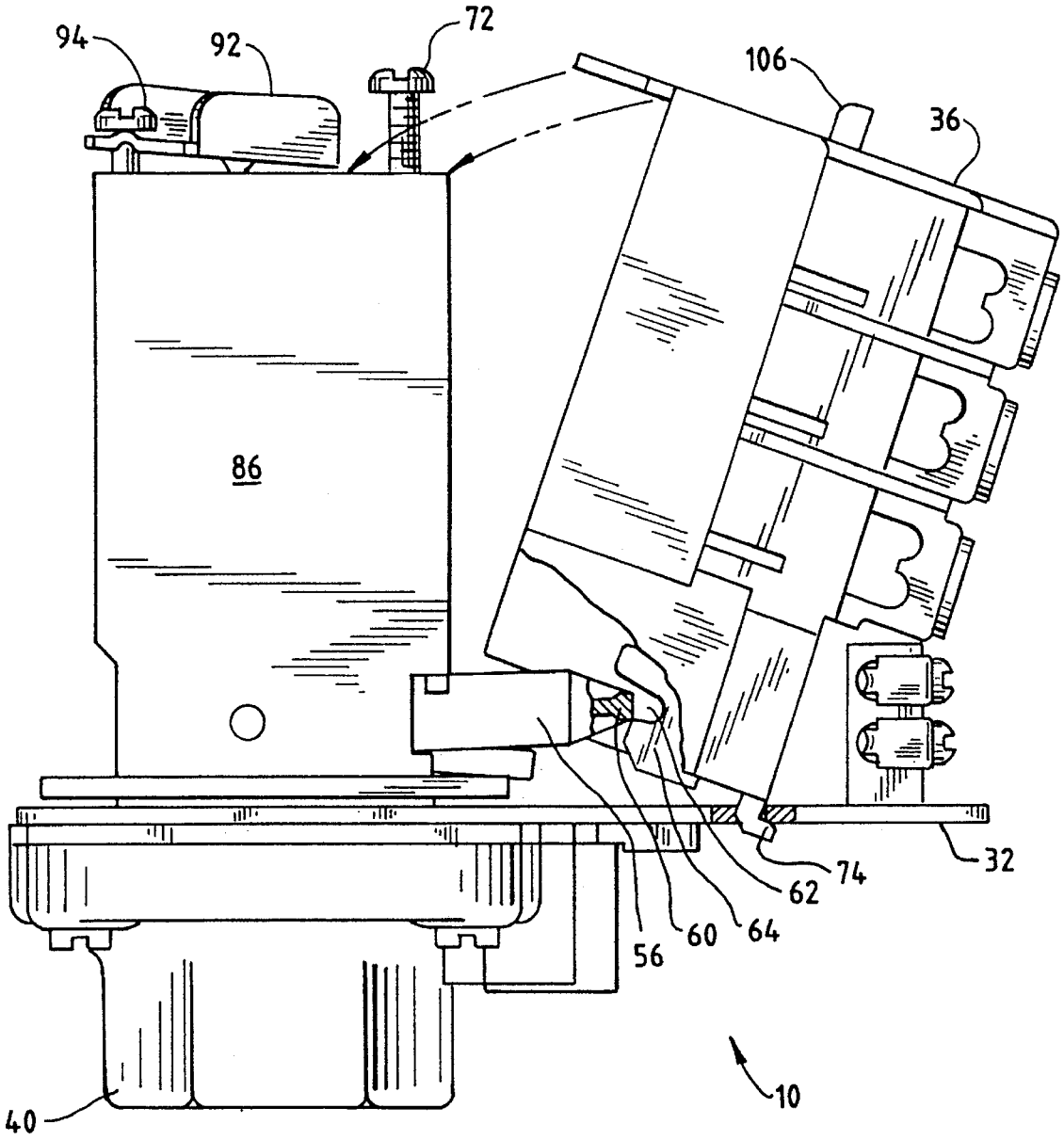
FIG. 3 is a left side view of the pressure switch of FIG. 3, shown without the protective case and with the modular contact block in partial dismount.

Turning to the embodiment of the invention disclosed in FIGS. 2 and 3, there is shown a pressure switch 10 comprising a base 32, a pressure sensing assembly 34, a contact block 36, and a cover or case 38. Mounted below the base 32 is a fixture 40 for attaching conduit (not shown) so that the switch 10 can monitor the pressure within a gas system.

The pressure sensing assembly 34 comprises a diaphragm 42 interposed between the fixture 40 and a diaphragm support 44. During operation, a pressure dependent force impinges upon the diaphragm 42, and this motion is transmitted to the diaphragm support 44 and a spindle 46 mounted to an engaging lever 48. At the end of the spindle 46 opposite the engaging lever 48 the spindle 46 is connected to an adjustable spring 50. Depending on the proportions (balance) between the adjustable spring force and the diaphragm support size, a pressure dependent movement of the spindle 46 is carried out.

The engaging lever 48 is interposed between the spindle 46 and the diaphragm support 44. The engaging lever 48 actuates a switch lever 52 to open and close an electrical circuit as will now be described. The switch lever 52 is joined by means of a leg spring 54 to a counterpoise 56 such that for the latter two stable stationary positions result. The change over points A and B are set so that torque moment sum of the counterpoise 56 passes the zero point in such a way that a movement in the direction of the opposing stationary point is triggered.

The switch lever 52 and counterpoise 56 rotate about a bearing 58. The counterpoise 56 has at its end opposite the bearing 58 an extension arm 60 that cooperates with a notch 62 displaced at the lower end of a contact carrier 64 such that movement of the contact carrier 64 in an up and down fashion is controlled by the counterpoise 56.

Figure 8:
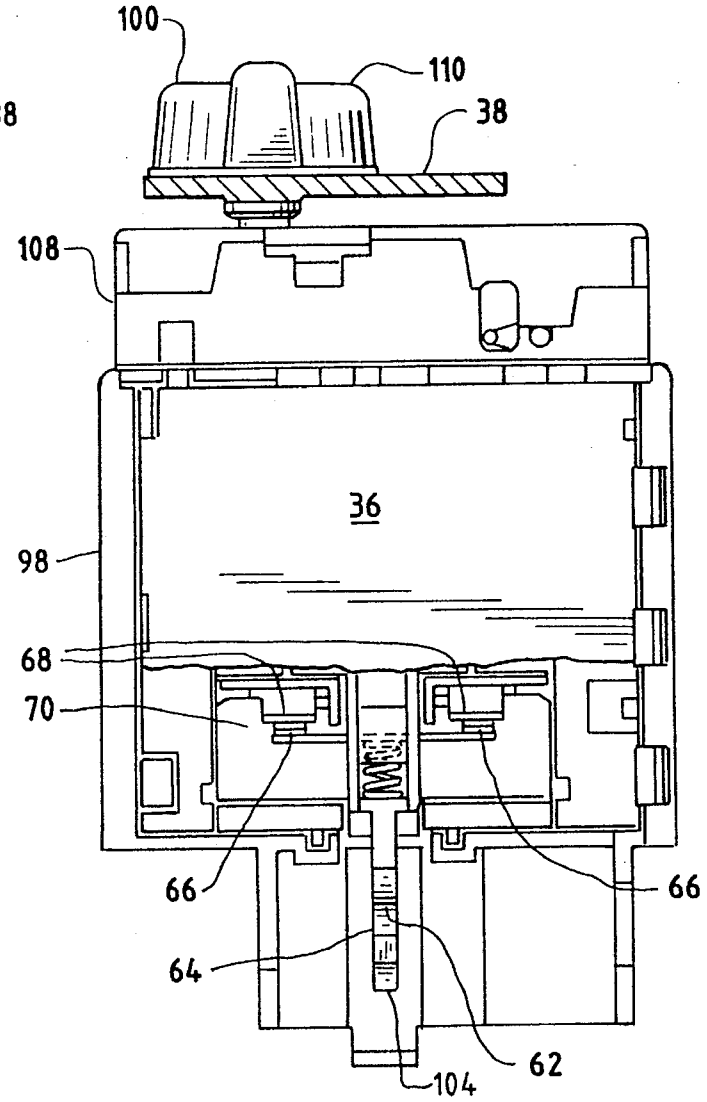
Figure 7:
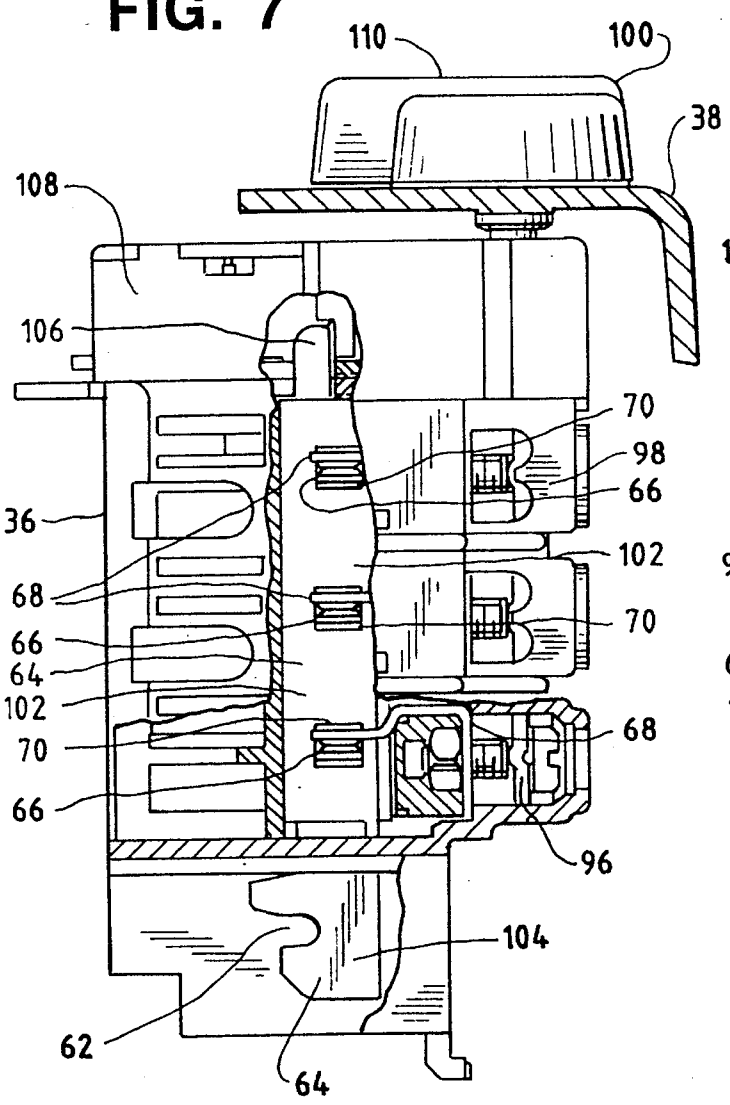
Figure 10:
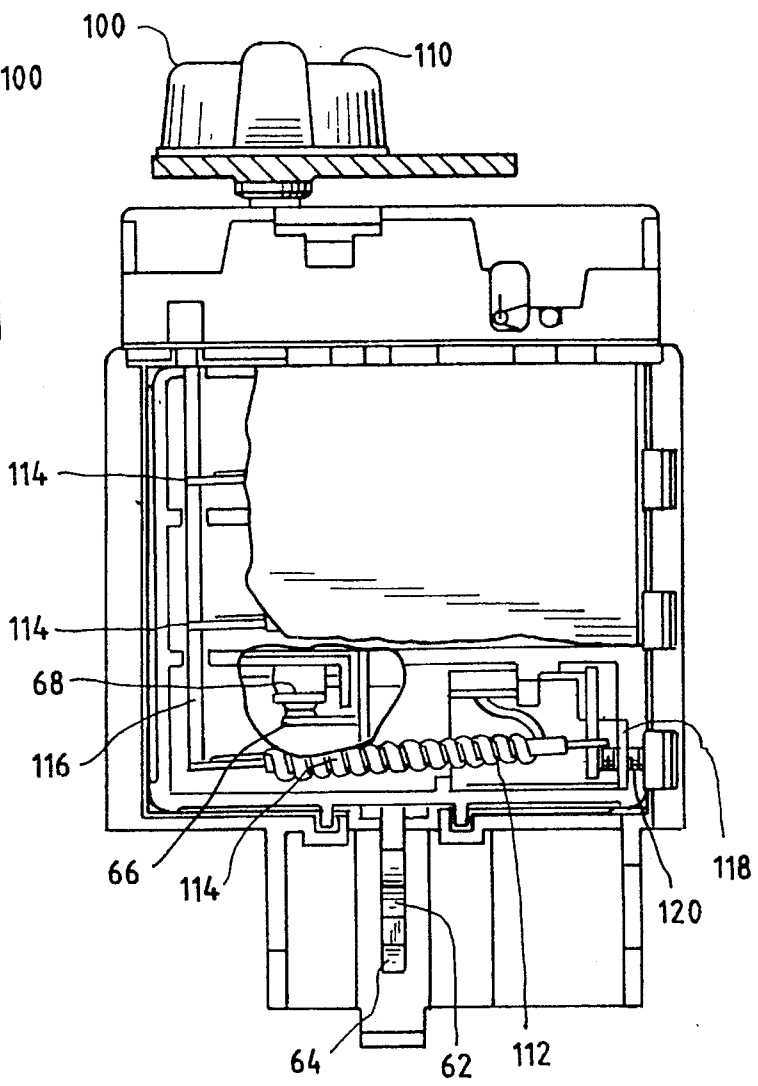
Figure 9:
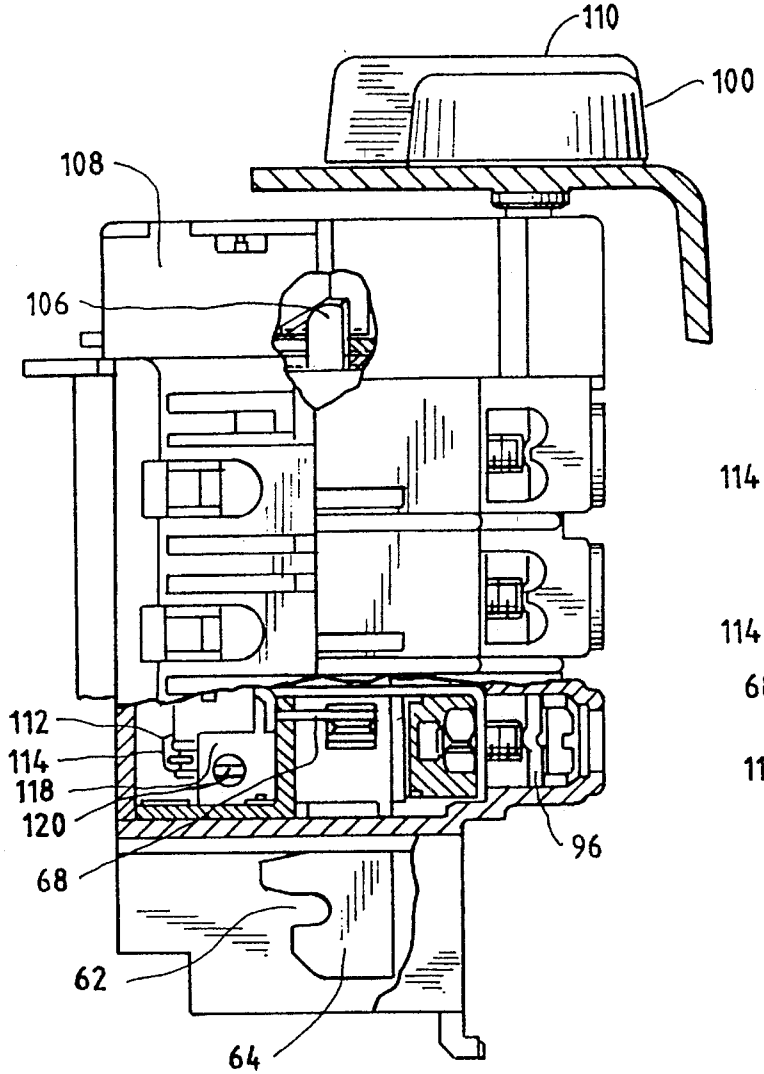

The contact carrier 64 can be fitted with one to three movable contact sets 66, as best shown in FIGS. 7 and 8. Together with fixed contacts sets 68 positioned within a contact chamber 70, these contacts 66, 68 make or break the circuit between the line (power source) and load (motor) side.

Various modular contact blocks 36 may be used with the present invention. These modular contact blocks 36 may be made from a suitable non-electrically conducting material mounted to the pressure sensing assembly 34 by means of screws 72 and to the base 32 via a tab 74 (FIG. 3). In this way the contact block 36 can be easily removed and replaced.

The pressure switch operates in the following manner. When the pressure in the system is low, the pressure switch 10 is configured such that the switch lever 52, the counterpoise 56, and the contact carrier 64 are in the positions shown by the unbroken lines in FIG. 2, designated as "A". In this configuration, the movable contact sets 66 engage the fixed contact sets 68, completing the electrical circuit. The activated compressor 14 refills the air tank 16 with ambient air.

As the system pressure increases, the diaphragm 42 deflects upwardly through an opening 76 in the diaphragm support 44, causing the engaging lever 48 to move in an upward direction. This movement by the engaging lever 44 causes the switch lever 52 to rotate counterclockwise (as viewed from the right side) about the bearing 58. When the pressure reaches a predetermined maximum, torque forces acting upon the counterpoise 56 by the leg spring 54 cause the counterpoise 56 to snap in a clockwise manner about the same bearing 58 from position "A" to position "B", indicated by the broken lines in FIG. 2. The clockwise movement of the counterpoise 56 causes the movable contact carrier 64 to move in a downward direction, causing the movable contact sets 66 to disengage the fixed contact sets 68, breaking the electrical circuit and shutting off the compressor 14.

The circuit remains broken until the system pressure reaches a predetermined minimum level. As the system pressure decreases, the pressure forces acting on the diaphragm 42 lessen, decreasing the amount of upward deflection of the diaphragm 42. This causes the engaging lever 48 to move downward, causing the switch lever 52 to rotate clockwise about the bearing 58. When the system pressure reaches the minimum level, torque forces acting upon the counterpoise 56 by leg spring 54 cause the counterpoise 56 to snap in a counterclockwise manner from position "B" back to position "A". The counterclockwise movement of the counterpoise 56 causes the movable contact carrier 64 to move in an upward direction, causing the movable contact sets 66 to engage the fixed contact sets 68, closing the electrical circuit and activating the compressor 14.

The operating pressure for the switch is determined by the downward force exerted on the engaging lever by the main spring 50. The main spring 50 has a lower end 78 that bears against a spring retainer 80 threadably connected to the spindle 46 and an upper end 82 which bears against the horizontal surface 84 of the main spring housing 86. The spindle 46 has at its upper end a screw type head 88 or other means for rotating the spindle 46. When the spindle 46 is rotated in one direction, the force of the main spring 50 opposing the upward movement of the engaging lever 48 and the diaphragm 42 can be increased. Rotating of the spindle 46 in the opposite direction decreases the force applied to the engaging lever 48 and the diaphragm 42 by the main spring 50. In this way, the pressure at which the switch 10 will be "on", i.e. the electrical circuit completed, can be adjusted.

In typical applications it is desired that the switch 10 operate on a differential pressure basis. That is to say, it is desirable that the pressure switch 10 open the electrical circuit, thereby shutting off the compressor motor 12, at a predetermined higher pressure, and close the circuit, thereby turning on the compressor motor 12, at a predetermined lower pressure. This is achieved by means of a differential pressure spring 90 which urges the spindle 46 upwardly by bearing down on one end of a lever 92 connected at its opposite end to the spindle screw head 88. The amount of upward force applied by the differential pressure spring 90 may be adjusted by a differential pressure screw 94 threadably connected to the differential pressure spring 90.

Most standard pressure switches have only two electrical contacts, with a third power line running directly to the motor. In such two-phase systems, a motor starter is required where the pressure switch acts as a relay to break the line going directly to the motor.

Figure 5B:
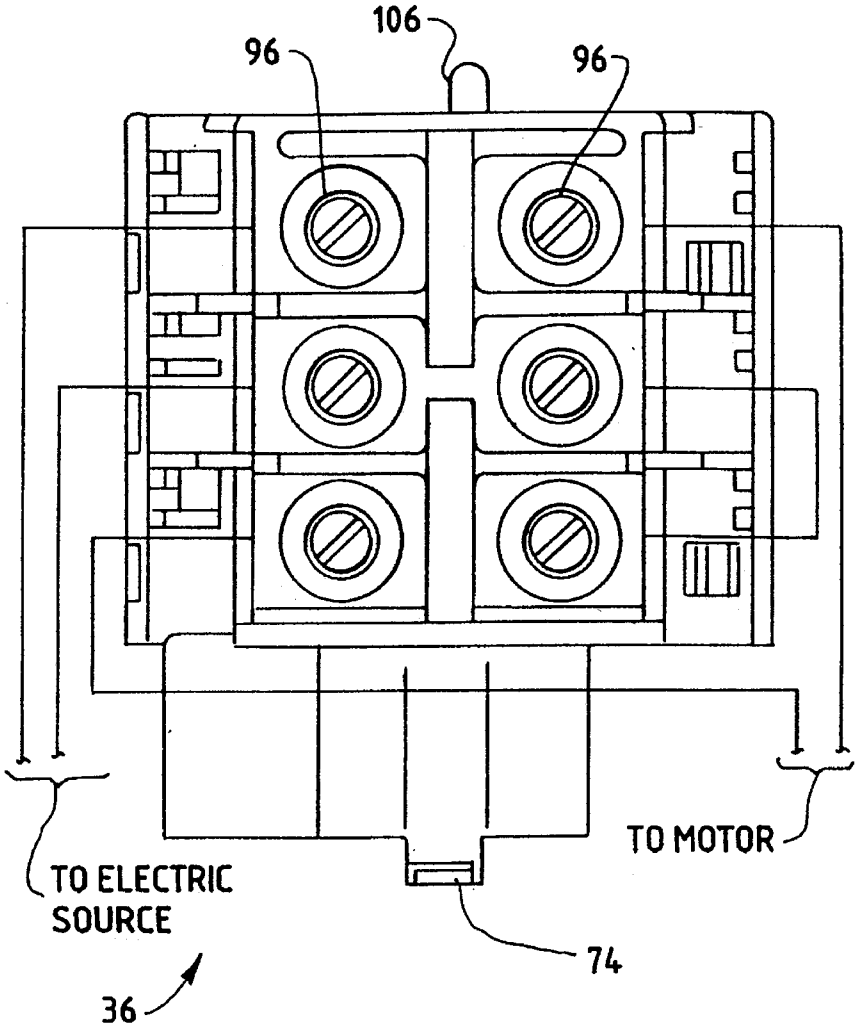
FIG. 5B is a rear view of the contact block showing the wiring scheme for a single phase system.

The present invention may comprise either a single phase or, preferably, a three phase switch. Illustrations of the wiring configurations for a three phase system and a single phase system are provided in FIGS. 5A and 5B respectively.

In a three phase system, when one of the phases is lost (eg. due to a blown fuse or a dropped wire), current will increase in the other two phases to take up the slack, which can burn out the motor. To prevent motor burn out, the present invention has phase fault protection. If one of the three phases is lost, current through the other two phases increases only slightly, thus preventing burn out of the motor.

Figure 4:
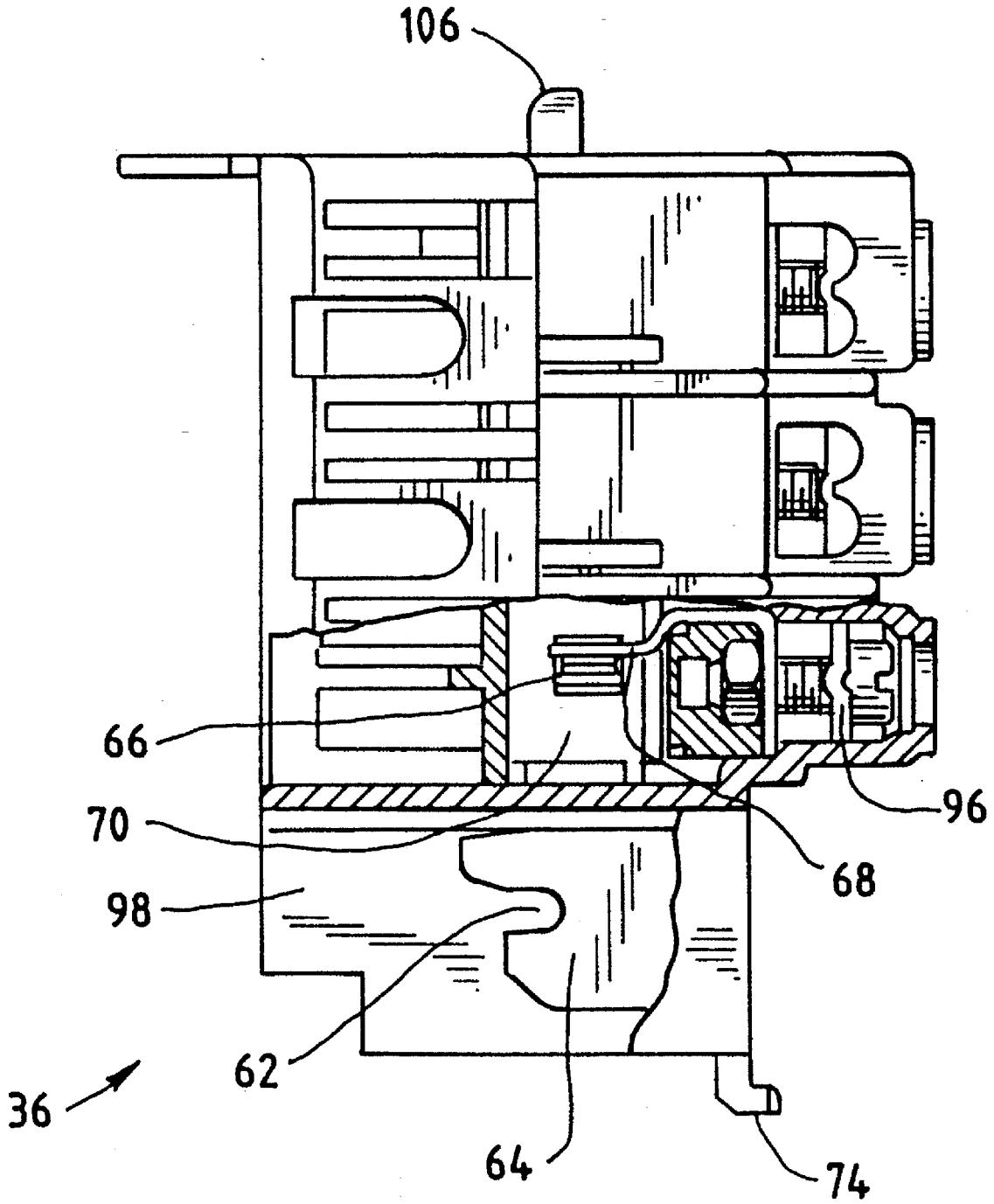
Figure 5A:
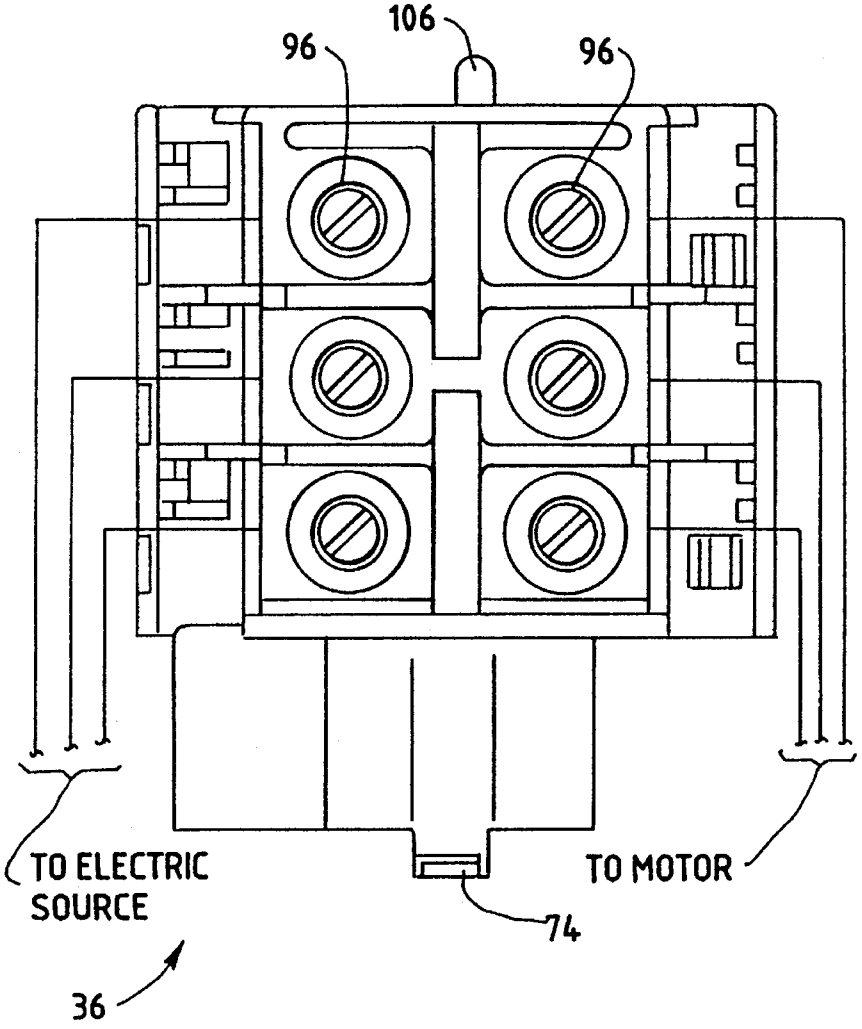
FIG. 5A is a rear view of the contact block showing the wiring scheme for a three phase system.
Figure 6:
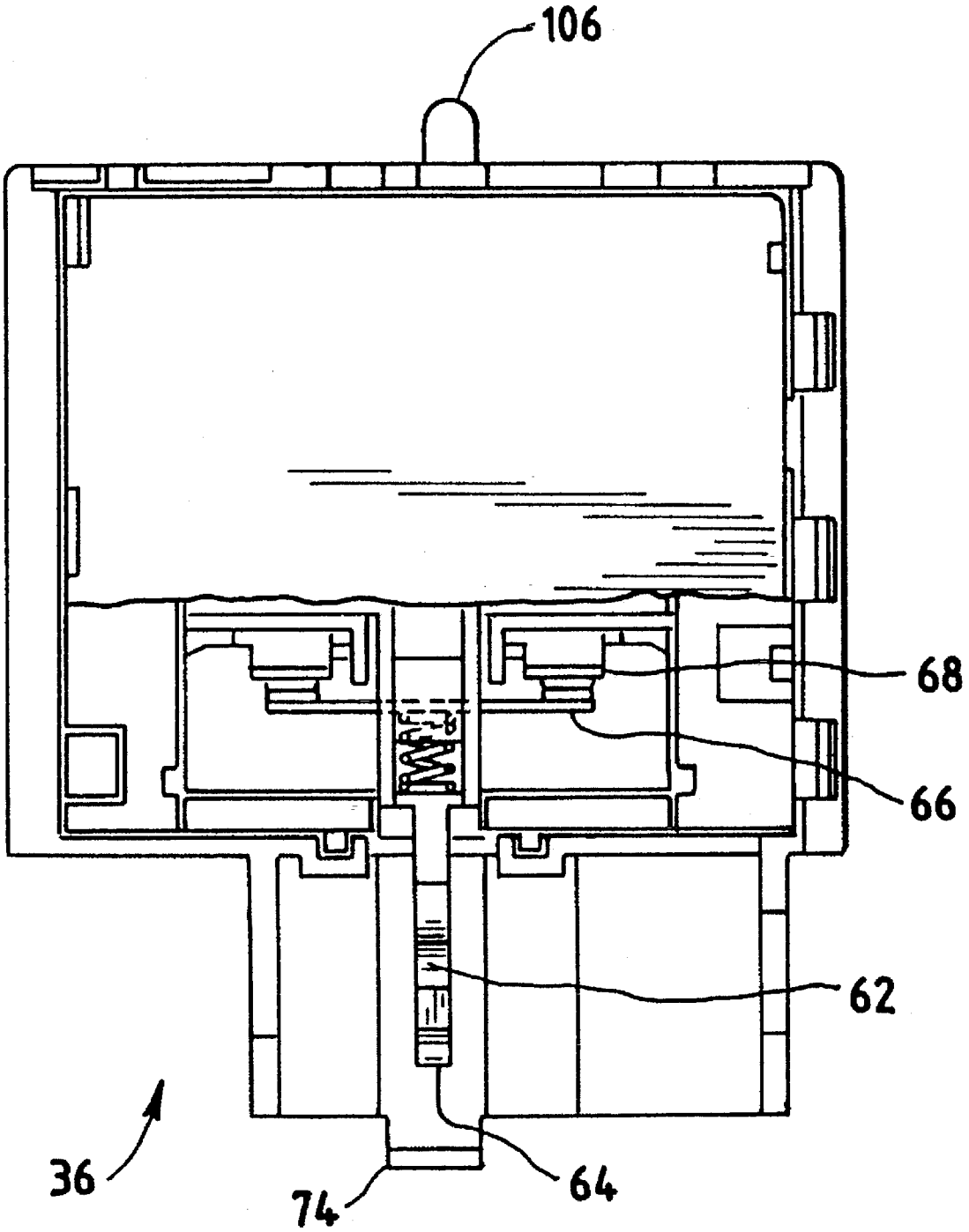

Three embodiments of the modular contact block 36 will now be described. The first embodiment, shown in FIGS. 4–6, is the modular contact block 36 only. In this embodiment, the pressure switch responds only to the pressure forces within the system acting on the pressure sensing assembly 34. The second embodiment, shown in FIGS. 7–8, is the modular contact block 36 with a mountable lock 108 that can be operated by a manual switch 110. The third (preferred) embodiment, shown in FIGS. 9–12, includes the modular contact block, mountable lock, and a unique thermal release device that also operates the mountable lock. Finally, there will be described undervoltage release/shunt trip devices, shown in FIGS. 17 and 18, for providing a third type of input to the mountable lock, in addition to the manual switch and thermal release device.

In the first embodiment of the modular contact block 36, shown in FIGS. 4–6, the contact block 36 comprises the movable contact carrier 64, contact sets 66 and 68, terminals 96 for each phase, and a contact block cover 98.

Each of the fixed contact sets 68 is electrically connected to a terminal 96. In the embodiment shown in FIGS. 4–6, six such terminals 96 are shown. When installed in a three phase system, three terminals are connected to a power source and three are connected to the motor (FIG. 5A). Each terminal 96 includes a generally L-shaped fixed contact set 68 which extends from the terminal 96 to a contact chamber 70 in which the movable contact carrier 64 is located.

The contact carrier 64 may be molded from any suitable electrically nonconductive material. As best shown in FIG. 7, the contact carrier 64 has a generally rectangular central portion 102, a notched lower end 104, and a narrow extending top end 106. Three openings 108 provided in the central portion 102 accommodate the movable contact sets 66. These movable contact sets 66 cooperate with the stationary L-shaped fixed contact sets 68 to either make or break the electrical circuit between the line (power source) and the load (motor) sides.

A second embodiment of the modular contact block 36 comprises all of the features of the first embodiment, plus a mountable lock 108 mounted on top of the contact block 36, as shown in FIGS. 7 and 8. The mountable lock 108 can be compulsorily brought to an "OFF" position (circuit broken) and retained in this position. This can be achieved either by means of a manual switch 110 or, as described below for the third embodiment, by a thermal release device 112 integrated in the lock 108.

The manual switch 110 has two positions: "OFF" and "AUTO" (automatic). Under normal operation, the manual switch 110 is set to "AUTO". In the "AUTO" position, the manual switch 110 does not effect the operation of the device. Instead, the three movable contact sets 66 are actuated by the pressure control assembly 34 in the conventional manner described above. The upper and lower pressure settings are, as already noted, adjustable.

If the manual switch 110 is set to "OFF", the contacts are always positively driven open by the action of the counterpoise 56. The manual switch 110 extends through the top of the pressure switch cover 38 and includes a knob 100.

The third (preferred) embodiment of the contact block 36 comprises all of the features of the second embodiment and adds a unique thermal release device 112 for which space within the contact block 36 has been provided, thus obtaining a combined pressure switch with thermal motor protection, as shown in FIGS. 9–12. In the preferred embodiment, the current flow for each phase is guided from the terminal 96 over wound bimetals 114 to its respective fixed contact 68.

The movable ends of the bimetals 114 are connected to the mountable lock 108 by a slide 116 in such a way that a given overcurrent will cause the lock mechanism to trip. This leads to the required opening of the contacts as described above.

The thermal release device 112 basically functions like a normal bimetal relay. Should the thermal release device 112 sense a hazardous current-time value for the motor, the lock mechanism 108 is driven to the "OFF" position and the current flow is positively interrupted.

The thermal release device 112 prevents overheating of the motor when either a mechanical or electrical problem arises. When there is a mechanical problem with the motor causing the motor to work harder, the amperage going into the motor increases. As the amperage increases, the temperature inside the motor increases. If this situation is allowed to continue (as in the case of some conventional pressure switches), the motor will eventually burn out.

When there is an electrical problem (i.e., overvoltage or undervoltage), either situation will cause the amperage, and thus the temperature of the motor, to increase, resulting in the same problem as with a mechanical failure.

The thermal release device 112 works in the following manner. The bimetals 114 mounted in the contact block 36 sense the amperage going into the motor. As this amperage increases, the temperature of the bimetals 114 increases, causing them to bend against the slide 116, pushing it upward. The upper end of the slide 116 then pushes against the ambient air compensation bimetal 124, causing the compensation bimetal 124 to rotate about a fulcrum (holding bar 126) in a clockwise direction. The opposite end of the compensation bimetal 124 pushes against member 142, causing it to rotate in a clockwise direction (FIG. 12). The rotation of member 142 causes locking member 144 to rotate clockwise as viewed from above. This clockwise rotation frees locking lever 146 from its locked position (shown in FIG. 11), thus tripping shift lever 140, causing it to rotate counterclockwise.

The contact carrier 64 impinges against the underside of the shift lever 140, such that when the shift lever 140 rotates counterclockwise, the contact carrier 64 moves upward, opening all three contacts within the pressure switch 10, interrupting the current flow and turning off the motor. The manual switch 110 remains in the "AUTO" position.

Figure 11:
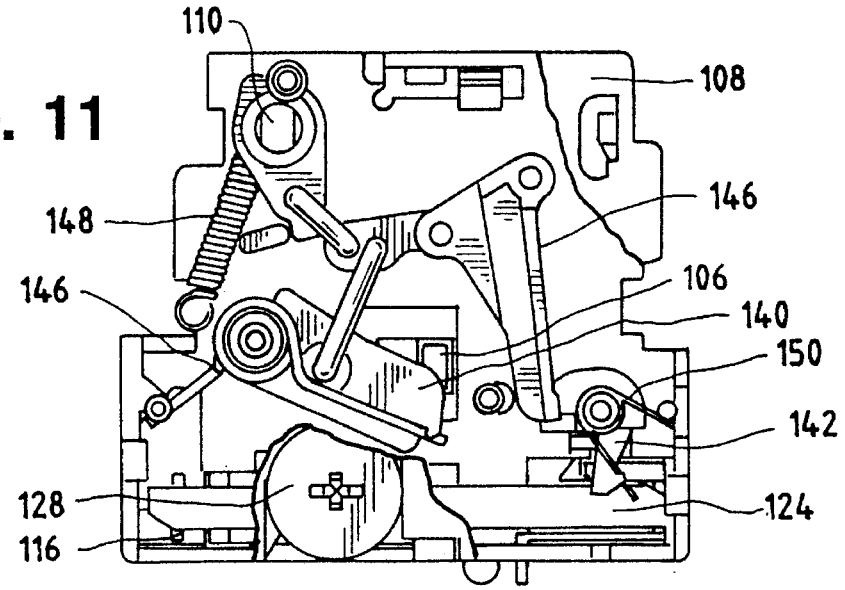
Figure 12:
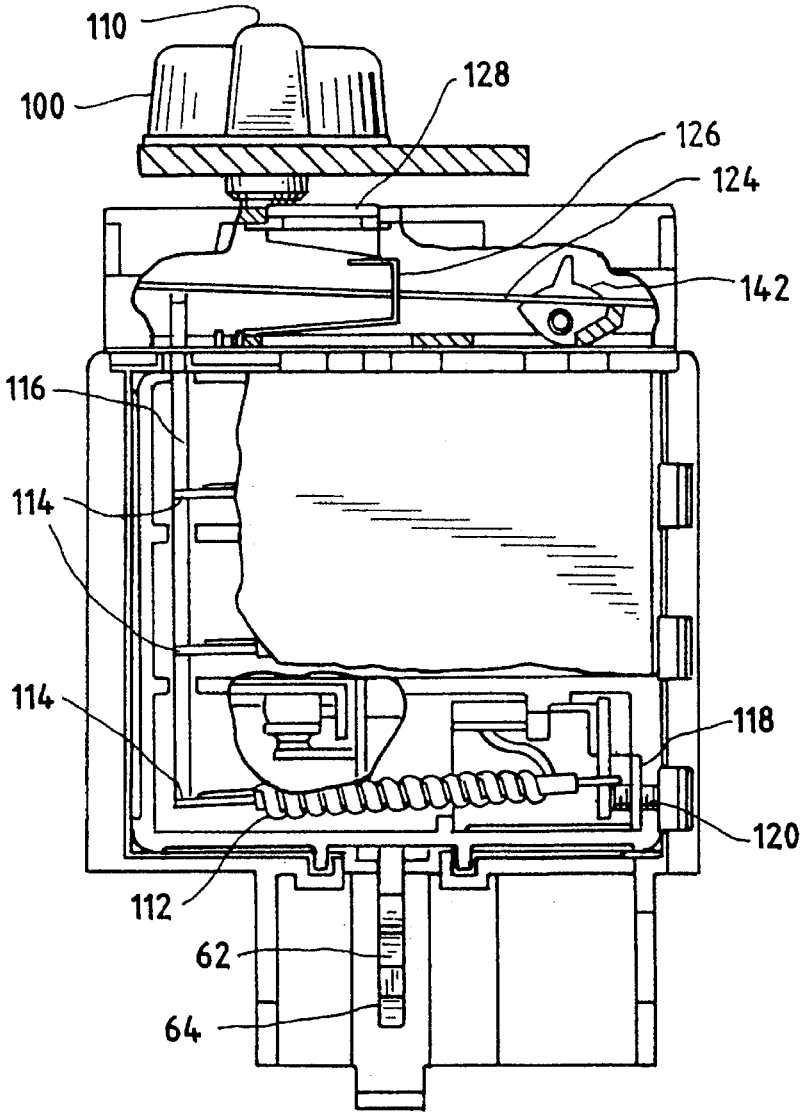

As shown in FIG. 11, a large tensioned spring 146 biases the shift lever in the counterclockwise position. A small tensioned spring 148 biases the manual switch 110 in the "OFF" position. U-shaped spring 150 biases the locking member 144 in a clockwise position.

After tripping, the locking mechanism is automatically reset. Cooling down of the bimetals 114 (presumably after the mechanical or electrical problem has been corrected) allows the slide 116 to move downward, the compensation bimetal 124 to rotate counterclockwise, locking member 144 to rotate clockwise, and shift lever 114 to rotate counterclockwise. This counterclockwise rotation of the shift lever 114 releases the contact carrier 64 for pressure dependent counterpoise movement and resets the locking mechanism. The pressure switch 10 is now started again. Manual reset is not required.

As best shown in FIGS. 13 and 14, adjusting and mounting fixtures 118 for the bimetals 114 are formed in such a way that each bimetal 114 is anchored within a cell and may be adjusted by means of a screw 120 held by the mounting fixture 118. Each fixed contact set 68 is provided with a sheet metal bracket 118. The sheet metal bracket's plane surface is bent downwards and in a given area again bent forward and upwards so that on the resulting plane 120 the bimetal 114 can be fixed (anchored) and adjusted by turning an adjusting screw 121. The area's material which is meant to be bent when adjusting (122 in FIG. 13) can be consciously weakened. Turning the adjusting screw 120 in a clockwise direction as shown in FIG. 14 causes the bimetal 114 to turn in the direction shown by the arrow.

The present invention is ambient, compensated by means of the ambient compensation bimetal 124. That is, the influence of ambient temperature is compensated for in a way that, despite the bending of the bimetals 114 due to changes in the ambient temperature, the tripping distance (i.e. the distance that the slide 116 must move to shut off the switch), and concomitantly the tripping current, remain nearly the same.

Figure 15:
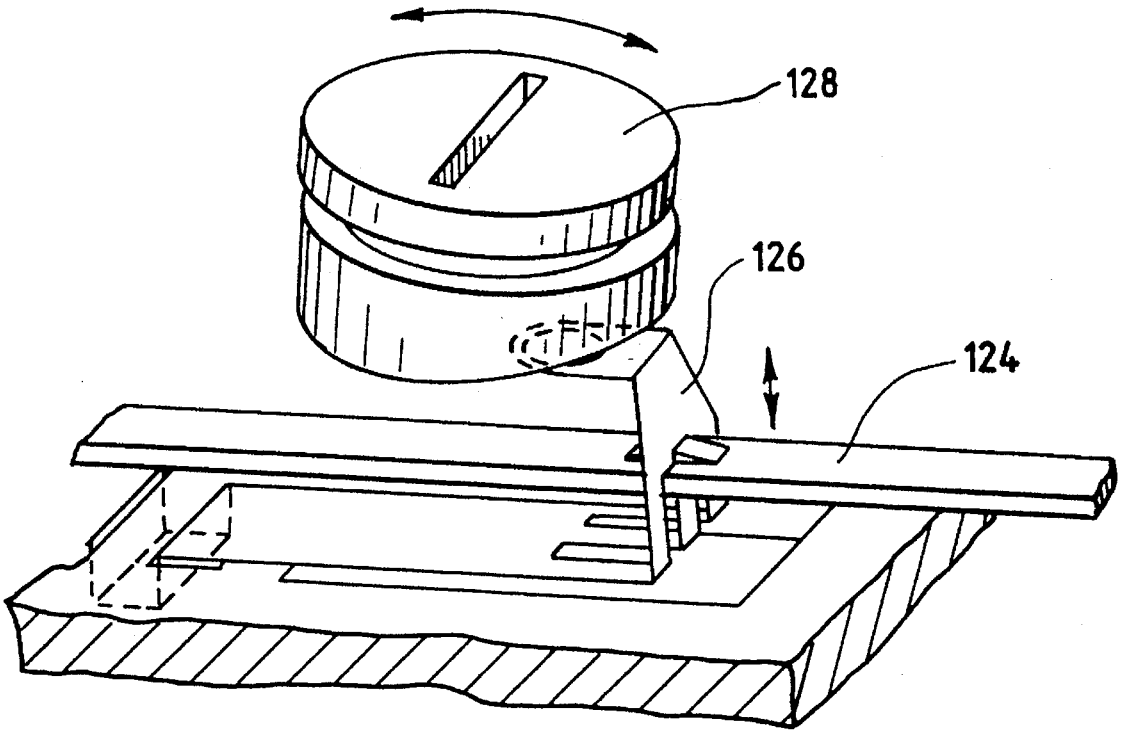
FIG. 15 is an enlarged perspective view of the ambient air compensation and the trip current adjustment means for the present invention.
Figure 16:
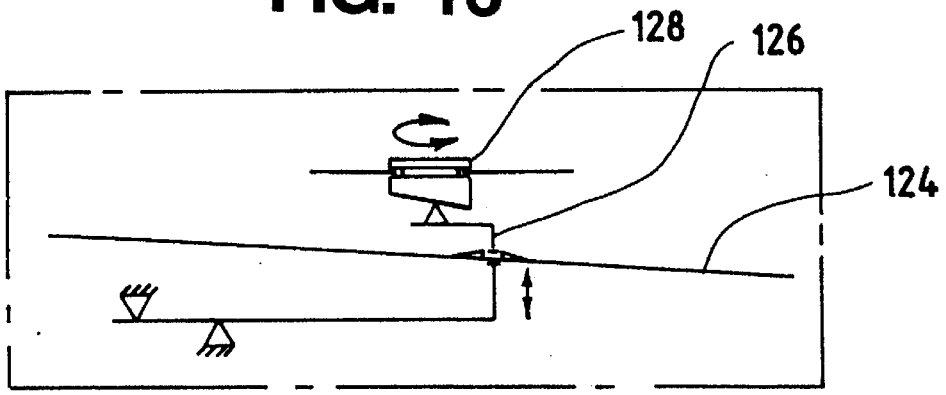
FIG. 16 is a schematic representation of the ambient air compensation and the trip current adjustment means of FIG. 15.

The tripping distance may adjusted for different tripping currents by shifting the position of the compensation bimetal 124 by means of an eccentric 128 (FIG. 15). As the eccentric is rotated, it impinges against a holding bar 126. As best shown in FIG. 16, this movement of the holding bar 126 moves the compensation bimetal 124 in a vertical direction, thus adjusting the distance necessary to trip the locking mechanism.

By adding a control device 132 such as an undervoltage release or shunt trip as an additional means for controlling the lock mechanism 108, which may be fitted by the user irrespective of the thermal release device complementation, additional possibilities for control tripping, e.g. emergency off, can be achieved. These devices act upon the mountable lock 108 by means of a shift mechanism so that in given circumstances the lock mechanism will be actuated to achieve the "OFF" position. If the release devices are energized, an "OFF" command is sent to the lock mechanism, causing the motor to be switched off.

Figure 18:
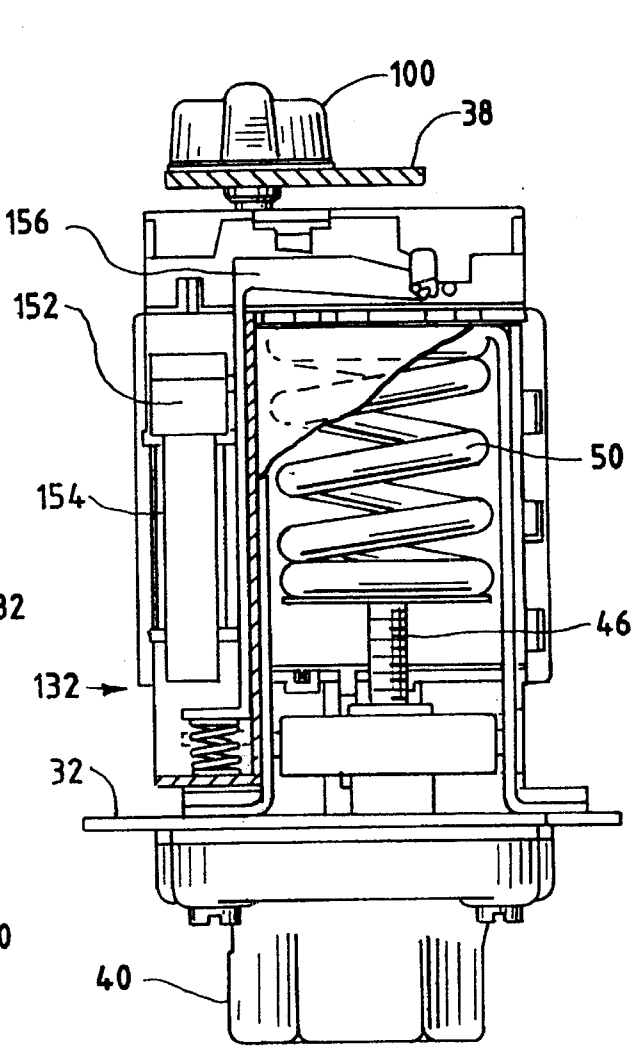
Figure 17:
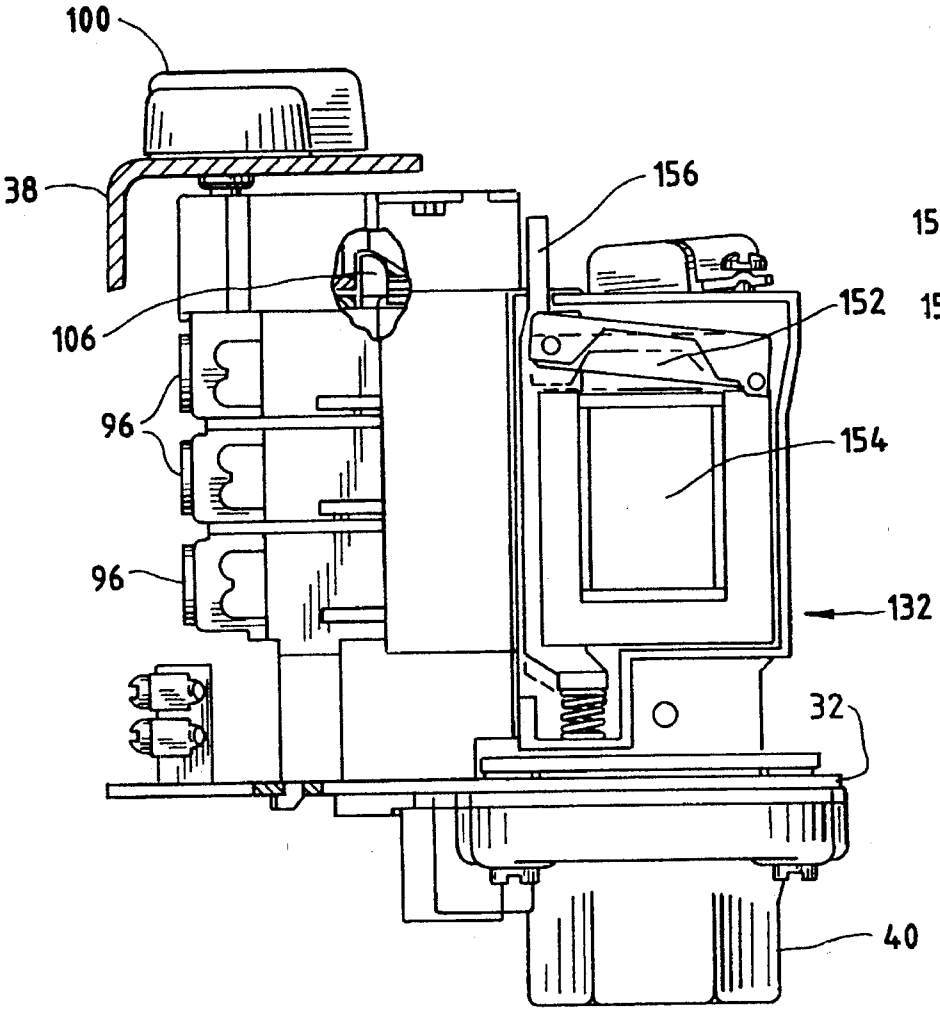

As shown in FIGS. 17 and 18, an undervoltage release or shunt trip 132 can be integrated in the pressure switch 10, and can be added to the pressure switch 10 irrespective of the thermal release device 112. The undervoltage release/shunt trip 132 can be snapped onto the pressure switch 10. The moving anchor 152 sitting atop the coil 154 activates a slider 156 which is connected with the locking mechanism in a way that, in case of a voltage drop (undervoltage release) or a transmitted voltage (shunt trip), the moving anchor 152 activates and disconnects the lock mechanism.

The shunt trip 132 allows the compressor 14 to be turned off by remote control in the case of an emergency. However, turning on the compressor 14 by remote control is not possible.

When the "OFF" position is achieved, an optional unloader valve 134 (depicted schematically in FIG. 19) for pipeline pressure relief (for compressor motor loadless starts) is automatically actuated. The unloader valve 134 may be mounted on the pressure switch 10 and is opened whenever the electric current to the compressor motor 12 has been interrupted, irrespective of the cause of the interruption. In this way it is guaranteed that the connecting pipe 26 between the compressor 14 and the pressure tank 16 is always pressureless when the motor 12 is restarted. Actuating the mounted unloader valve 134 for pipeline pressure relief (for compressor motor loadless starts) is always automatically achieved, when the "OFF" position is reached.

Figure 19:
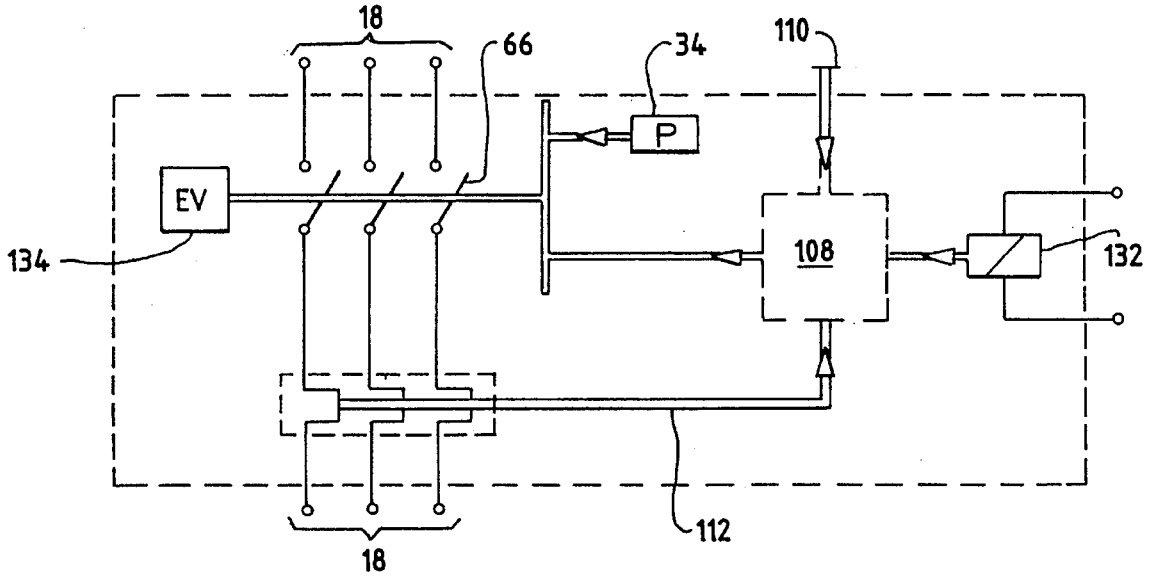
FIG. 19 is a schematic representation of the pressure switch of the present invention incorporating the third (preferred) embodiment of the modular contact block, an undervoltage release/shunt trip device, and an unloader valve.

FIG. 19 is a diagrammatic representation of the compact control and monitoring device of the present invention. Among the advantages of this design are (1) components of the conventional circuit are incorporated in a very compact device, (2) much less wiring efforts are needed, and (3) pressureless motor start up is ensured by an optional unloader valve. The connections for pressure air and relief pipe are not shown.

All input "OFF" commands, whether via manual switch 110, thermal release device 112, or undervoltage release /shunt trip control 132, always have priority. That is, should the lock mechanism 108 be activated by an "OFF" command via any of these three inputs, the contacts are opened irrespective of whether the pressure component demands either "ON" or "OFF". Furthermore, releasing the contacts by setting the manual switch to AUTO is not possible if an "OFF" command is registered at either the thermal overload monitor input or the undervoltage release /shunt trip control input.

Should the contacts be opened via an "OFF" command to the lock mechanism, 108 e.g. as a result of an undue high current-time value, then the manual switch 110 is set to the "OFF" position. Operators can easily recognize that a fault has occurred by looking to see if the manual switch 110 is set to "OFF". When the contacts 66, 68 are opened by the pressure monitor 34, the manual switch 110 remains in the "AUTO" position.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A pressure control device comprising a base, means for sensing the pressure in a system mounted to said base, and a removable contact block mounted to said base, said contact block having a plurality of cells and comprising:

a contact block cover;

a plurality of fixed contacts, each mounted within a cell; and a lock mounted onto the contact block cover, wherein the lock can be compulsorily bought to an "OFF" position in response to any of three inputs, said inputs consisting of a manual switch, a thermal release device, and a remote control device;

said thermal release device being integrated into the contact block so that electrical current:flowing through the contact block is guided over wound bimetals to the fixed contacts, said bimetals being at one end connected to the lock by a slide such that overcurrent will cause the lock to be brought to an "OFF" position.

2. The pressure control and monitoring device of claim 1 in which the remote control device is a shunt trip for allowing an operator to shut off the switch from a remote location.

3. The pressure control and monitoring device of claim 2 in which the shunt trip is integrated into the pressure control and monitoring device.

4. The pressure control and monitoring device of claim 1 further comprising an unloader valve to reduce the pressure in the pipe between a compressor motor and a pressure tank after the pressure control and monitoring device has been deactivated, allowing for pressureless startups when the compressor motor is restarted.

5. A pressure control device comprising a base, means for sensing the pressure in a system mounted to said base, and a removable contact block mounted to said base, said contact block having a plurality of cells and comprising:

a cover;

a plurality of fixed contacts, each mounted within a cell; and a lock mounted onto the contact block, wherein the lock can be compulsorily bought to an "OFF" position in response to any of three inputs, said inputs consisting of a manual switch, a thermal release device, and a remote control device, each being integrated into the contact block to provide a single compact unit;

wherein electrical current flowing through the contact block is guided over wound bimetals to the fixed contacts, each of said bimetals being at one end connected to the lock by a slide such that overcurrent will cause the lock to be brought to an "OFF" position.

6. The pressure switch of claim 5 wherein the temperature at which the thermal release device shuts off the pressure switch is determined by the tripping distance of the slide.

7. The pressure switch of claim 5 further comprising means for minimizing the effect of ambient air temperature on the operation of the thermal release device.

8. The pressure switch of claim 7 wherein said means for minimizing the effect of ambient air temperature comprises a compensation bimetal operably connected to the slide so as to maintain approximately the same tripping current at different ambient temperatures.

9. The pressure switch of claim 8 further comprising an eccentric for moving the compensation bimetal in a vertical direction in order to adjust the distance the wound bimetals must bend to trip the lock.

10. The pressure switch of claim 5, wherein the removable contact block further comprises an electrically nonconductive movable contact carrier having a generally rectangular central portion, a notched lower end, a narrow extending top end, and a plurality of openings in the central portion of the contact carrier for accommodating movable contact sets, said movable contacts sets being configured to cooperate with the fixed contacts to either make or break an electrical circuit.

11. The pressure switch of claim 10 wherein the notched lower end of the movable contact carrier engages a switch means, said switch means being activated by the means for sensing pressure in a system.

12. The pressure switch of claim 11 wherein the means for sensing pressure in a system comprises a flexible diaphragm open to the system that acts upon a spindle mounted to an engaging lever interposed between the spindle and the diaphragm, and an adjustable spring connected to an end of the spindle opposite the engaging lever, whereby pressure dependent movement of the spindle is carried out.

13. The pressure switch of claim 12 wherein the switch means comprises a switch lever connected at one end to the engaging lever, and a counterpoise joined to the opposite end of the switch lever by a leg spring, said counterpoise having an extension arm that cooperates with the notched lower end of the contact carrier such that movement of the contact carrier is controlled by the counterpoise.

14. A pressure control device comprising a base, means for sensing the pressure in a system mounted to said base, and a removable contact block mounted to said base, said contact block having a plurality of cells and comprising:

a contact block cover;

a plurality of fixed contacts, each mounted within a cell; and a lock mounted onto the contact block cover, wherein the lock can be compulsorily bought to an "OFF" position in response to any of three inputs, said inputs consisting of a manual switch, a thermal release device, and an undervoltage release for automatically turning off a compressor motor when voltage to the compressor motor decreases to a predetermined level;

said thermal release device being integrated into the contact block so that electrical current flowing through the contact block is guided over wound bimetals to the fixed contacts, said bimetals being at one end connected to the lock by a slide such that overcurrent will cause the lock to be brought to an "OFF" position.

15. The pressure control and monitoring device of claim 14 in which the undervoltage release is integrated into the pressure control and monitoring device.

* * * * *

UNITED STATES PATENT AND TRADEMARK OFFICE

CERTIFICATE OF CORRECTION

PATENT NO. : 5,552,646

DATED : Sep. 3, 1996

INVENTOR(S) : Dieter Frede

It is certified that error appears in the above-identified patent and that said Letters Patent is hereby corrected as shown below:

Column 7, after line 67, insert the following paragraph:
-- The thermal release device 112 should be sized to match the current passing through the motor 12. For example, if the thermal release device 112 has a 20 amp switch and the motor 12 is 3 amp, the contact block 36 should be exchanged for one having a thermal release device in the lower (three amp) range. As noted above, the contact block 36 is modular and can readily be switched out and replaced.--

Column 8, line 1: after "may" insert --be--.

Column 9, line 17: after "a contact block cover;"insert --a plurality of wound bimetals;--.

Column 9, line 27: delete ":".

Column 9, line 27: delete "flowing through the contact block is guided over" and replace with --flows through the--.

Column 9, line 30: after "will" insert --activate the thermal release device and--.

Signed and Sealed this

Fourteenth Day of January, 1997

Bruce Lehman

*Attest:*

BRUCE LEHMAN

*Attesting Officer*

*Commissioner of Patents and Trademarks*